United States Patent [19]

Artbauer

[11] 4,160,119

[45] Jul. 3, 1979

[54] HIGH VOLTAGE ELECTRICAL CABLES

[75] Inventor: Jan Artbauer, Langenhagen, Fed. Rep. of Germany

[73] Assignee: Kabel-und Metallwerke Gutehoffnungshuette AG, Fed. Rep. of Germany

[21] Appl. No.: 625,583

[22] Filed: Oct. 24, 1975

Related U.S. Application Data

[63] Continuation of Ser. No. 270,585, Jul. 11, 1972, abandoned.

[30] Foreign Application Priority Data

Jun. 7, 1972 [DE] Fed. Rep. of Germany ..... 2134888

[51] Int. Cl.[2] ..... H01B 9/04; H01B 17/58

[52] U.S. Cl. ..... 174/28; 138/112; 138/114; 174/16 B

[58] Field of Search ..... 174/28, 29, 99 B, 88 B, 174/16 B; 138/113, 114, 121, 122

[56] References Cited

U.S. PATENT DOCUMENTS

| | | | |
|---|---|---|---|
| 2,210,400 | 8/1940 | Fisher et al. | 174/28 |
| 3,391,243 | 7/1968 | Whitehead | 174/28 |

FOREIGN PATENT DOCUMENTS

| | | | |
|---|---|---|---|
| 932619 | 9/1955 | Fed. Rep. of Germany | 174/28 |
| 397081 | 8/1933 | United Kingdom | 174/28 |

*Primary Examiner*—Arthur T. Grimley
*Attorney, Agent, or Firm*—Marn & Jangarathis

[57] ABSTRACT

High voltage electrical cable comprising an inner elongated conductive member, a corrugated metallic tubular member positioned about such inner member, and a plurality of nonconductive spacers each positioned along the longitudinal axis of the electrical cable and extending between said members through a nonconductive environment comprising, for example, a gaseous, foam or liquid insulator. To avoid premature insulation breakdown or sparkover in the vicinity of the spacers, such spacers are so configurated and positioned that their end portions coming into engagement with the corrugations of the surrounding tubular member follow the profile of the engaged corrugations so as to extend into the corrugation troughs thereof.

2 Claims, 14 Drawing Figures

HIGH VOLTAGE ELECTRICAL CABLES

Figure 1:
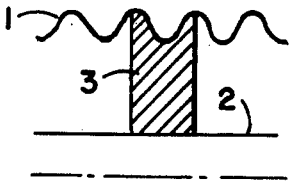

This is a continuation of application Ser. No. 270,585, filed July 11, 1972, now abandoned.

The present invention is directed to an improved high voltage electrical cable comprising insulated spacers of novel configuration and positioning for achieving improved mechanical and electrical cable characteristics. More specifically, the present invention is directed to gaseous, foam or liquid insulated high voltage, or high frequency, cable which may comprise a cylindrical, tubular-shaped or stranded inner conductive member that is held, for example, coaxially within a metallic tubular member corrugated at least in part, and having an environment therebetween of insulating gas foam or liquid.

Notwithstanding that potential differences are to be experienced between the inner conductive member and the surrounding corrugated metallic tubular member, it is generally desirable to provide a cable of minimal diameter by having a sparkover or insulation breakdown voltage between the surface of the spacers and the corrugated surface of the tubular member approximately as close as possible to the sparkover or insulation breakdown voltage of the insulating environment between the inner conductive member and the tubular member.

Spacers presently used for high voltage electrical cables of the type to which the instant invention relates, are generally configurated so that they contact the surrounding corrugated tubular members on the inverted ridges (valleys) of the corrugations. Such arrangements are encumbered by mechanical as well as electrical deficiencies. Mechanically such contacts with the inverted ridges are characterized as a linear or line contacts, and a slight force borne by the spacers when, for example the cable is bent, will result in a high mechanical pressure differentials in the line contact which may result in misalignments and other mechanical defects. Electrically such linear or line contacts with the inverted ridges provide finite wedge spacing between said inverted ridges and the usually cyclindrical surface of the spacers immediately adjacent to the ridges. This wedge spacing often results in a sparkover or insulation breakdown path at relatively low field intensity, i.e., such spacing breaks down at a voltage substantially lower than the sparkover or breakdown voltage of the insulating environment between the inner member and the tubular member.

The above-noted wedge spacing sparkover or insulation breakdown may be somewhat altered by the application of thin layers of metal, conducting or semiconducting lacquer, etc. on the cylindrical surfaces of the spacers. Although such application suppresses the sparkover or insulations breakdown across the wedge spacers, sparkover or insulation breakdown nevertheless often occurs in the vicinity of the periphery of each of such conducting layers, with associated undesirable results. If such conductive layers of such spacers are thick walled metal rings with rounded edges, instead of thin layers, then the greater thickness of these metal parts reduces the effective distance to the inner conductive member, thus resulting in an unfavorable effect on the sparkover or insulation breakdown voltage between the inner member and the surrounding tubular member.

The above-noted difficulties are overcome by the instant invention by providing spacers that extend into the corrugation troughs of the surrounding tubular member, their end portions adjacent such tubular member essentially following the corrugation profile at the area of contact, and the side limits of the spacer profile extending substantially within the corrugation troughs, and terminating between the corrugation ridges or peaks, as viewed by a section plane comprising the cables longitudinal axis. With this spacer design, not only are the wedge spacing and increased field strength on the edge of the conducting layer or metallic edge eliminated, which previously caused premature discharges and reduced sparkover voltages, but the sparkover voltage to the spacer is at a high level due to the fact that the field strength is substantially lower at the point where the side areas of the spacer reach the potential of the corrugated tubular member than it would be outside of the corrugated trough.

In executing the invention, it has been found to be particularly advantageous to also take advantage of priorly known measures to increase the sparkover voltage. Thus, for example, the surface of the spacers adjacent inner conductor and the surrounding tubular member, are provided with a conducting layers, e.g. a conducting strip of paint, a metal-plating, or adhering metal part. It is also advisable to electrically unburden the point where the side areas of the spacers terminate onto the inner conductor, e.g., by suitable shaping, or also by using the principle known in the field of rod insulators as "imbedded electrodes" or by combining both procedures.

The conductive layers may be comprised of an elastomer or of a highly-elastic plastic and compensate by its elasticity the inaccuracies of the tubular member used, the spacers and the inner conductive member which may otherwise lead either to gaps between the spacers and the tubular member or the inner conductive member or, on the other hand, to an undesirable increase in the mechanical pressure on the spacers.

When the surrounding member designed as a corrugated tube is bent, the corrugation profile is deformed, on the outside of the arc the corrugations expand, and on the inside they contract, in a ratio corresponding to the ratio of the average tube radius to the radius of curvature. In accordance with the present invention, it has been found to be advantageous to select the wall thickness of the spacers in the corrugation troughs in correspondence with the mechanical properties of the spacers in such a way that when the corrugation profile is changed, the spacers are only elastically deformed without suffering permanent damage. For this reason, it is advantageous to select insulating materials for the spacers which display a certain elasticity along with high mechanical strength, such as polycarbonate, polyphenyloxide (PPO), or polysulfon.

For the continuous production of long lengths of, e.g., gas-insulated cables constructed in accordance with the instant invention at economical speeds, the conventional procedures for installing disk-shaped spacers are not particularly well suited. Better suited are those procedures in which the spacers are moved sideways on the inner conductive member. In this case a jacketing process may be most favorably utilized pursuant to which a long metal strip is shaped into a tubular member, is longitudinally welded at its abutting edges, and then corrugating the thus-produced tubular member. Such a procedure requires spacers that are not self-closed.

A preferred form of spacers for cables in accordance with the present invention may comprise two, three, or more radially axisymmetrically installed supporting elements. The individual, usually three, supporting elements can be mounted on the inner conductive member, by gluing or welding together, but they can also be connected by holding them mutually in the desired symmetrical position around an inner conductive member. The connecting elements can be elastic and thus the sideways movement of the spacers is possible with subsequent attachment without gluing, welding, etc. to the inner conductive member.

In execution of the present invention, it has been found to be especially advantageous to use those spacers that differ from the conventional arrangement in that a spring-loaded element which holds the individual supporting elements together at the same time is installed within the corrugation troughs of the surrounding corrugated tubular member. The electrical field within such an arrangement is distorted to a lesser degree by such an element installation than in other arrangements, and consequently its presence does not have an unfavorable effect on the sparkover or insulation breakdown voltage between the inner member and the surrounding member. The spring-loading element can be composed of various substances such as steel, bronze, or other metal, or of plastic. The various shapes, round, flat, etc. may be connected in different ways to the supporting elements, e.g. mechanically by pressing gluing, or welding, particularly when plastic is involved, are possible. It is also possible, however, and often especially advisable to produce the spring-loading element at the same time and together with the supporting elements, e.g., by injection molding. The spring-loading element can also consist of several layers, e.g., a conducting or semiconducting layer and a covering insulating layer.

Figure 2A:
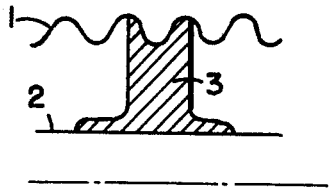
Figure 2B:
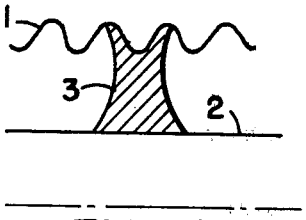
Figure 3A:
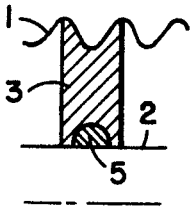
Figure 3B:
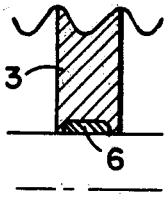
Figure 3C:
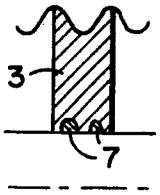
Figure 3D:
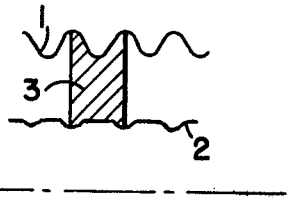
Figure 4:
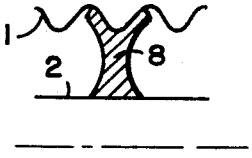
Figure 5A:
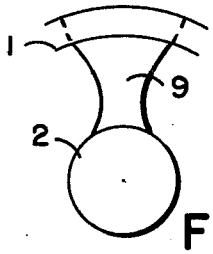
Figure 5B:
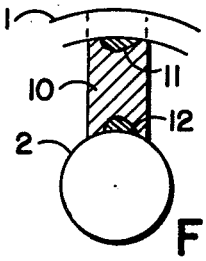

For a more complete understanding of the practical application of the present invention, reference is made to the appended drawings in which:

FIG. 1 is a partial sectional view of a cable comprising spacers which extend into the corrugation troughs in accordance with the instant invention;

FIGS. 2*a* and 2*b* are partial sectional views of variants of the cable depicted by FIG. 1, having extended spacer base portions that electrically unburden the points where the side areas of the spacer end on the inner conductive member;

FIGS. 3*a* through 3*d* are partial sectional views of variants of the cable depicted by FIG. 1, having space base portions adjacent the inner conductive member that include one or more excavations for conducting layers of conducting or semiconducting materials or in the case of FIG. 3*d*, having an inner conductive member which is also corrugated;

FIG. 4 is a partial sectional view of a variant of the cable depicted by FIG. 1, which is adapted for experiencing bending stresses;

FIGS. 5*a* and 5*b* are partial profile views of exemplary spacers appropriate for inclusion in the embodiments partially depicted in FIGS. 2*b* and 3*a*, respectively; and FIGS. 6*a* and 6*b*, and 6*c* and 6*d*, are partial views of variants of the cable depicted in FIG. 1, having spring-acting elements positioned in the corrugation troughs.

FIG. 1 depicts a sectional view of the upper half of a coaxial cable embodiment of the instant invention, wherein the surrounding corrugated tubular member is designated 1, the inner conductive member 2, and an insulating spacer 3. The spacer 3 extends into the trough between the corrugations in such a manner that the end planes essentially follow the corrugation profile and their side areas end still inside the wave throughs, when viewed from inside the pipe. In this embodiment, a corrugation inverted ridge (valley) lies between the side surfaces of the spacer 3, but the number of such inverted ridges lying between the side surfaces of the spacer 3 can be other than one, e.g. three or even zero.

Though, as depicted in FIG. 2*a*, the spacer 3 may have a base portion that has a flange profile configuration so as to electrically unburden the points where the side areas of the spacer 3 engage the inner conductive member 2; or as depicted in FIG. 2*b*, may have an arced profile to provide a larger area of contact with the inner conductive member 2; electrical discharge can also be prevented by having the spacer 3 having one or more excavations at their ends adjacent the inner conductive member 2. These excavations may be provided with a conducting layer 5 or completely filled with a conducting or semiconducting material, as depicted in FIGS. 3*a*, 3*b*, and 3*c*, by the designations 5,6,7. The variant shown in FIG. 3*d* differs from those according to FIGS. 3*a*, 3*b* and 3*c* in that the inner conductive member 2 is not designed with a smooth surface but itself has corrugations, and the spacer 3 also terminates with its side areas on its ends adjacent toward the inner conductive member 2 in corrugation troughs. The effect thus achieved is the same as if a basically smooth inner conductor bordered on a spacer with an excavation including either metal plating on its inner surface or filled with a conducting or semiconducting material.

In order to deal with the circumstances arising when the tubular member 1 is under bending stresses, it may often be of advantage to select the wall thickness of the spacer 3 in the corrugation troughs of the tubular member 1 in correspondence with the mechanical properties of the insulating material of the spacer in such a way that the forces acting when the wave profile is changed due to external mechanical effects on the spacer deform the latter only elastically. Such a possibility is represented as a variant example in FIG. 4 in which the spacer 8 with a central profile cross section essentially smaller in relation to the average pitch between the corrugation troughs of tubular member 1.

The variant examples represented in FIGS. 1 to 4 and similar profiles that can be derived from these basic forms can be considered as a section through a disk-shaped spacer. Such spacers can be moved on the inner conductive member in longitudinally direction or be cast in a mold directly on the conductive member present, or even injection molded. However, if high production speeds are desired, then production procedures in which the spacers are moved sideways onto the inner conductive member are more advantageous. For this, however, spacers are required which are not self-closed as in the case of the disk-shaped designs. The measures represented on the variant examples according to FIGS. 2*a* through 4 for the electrical discharging of the side surfaces of the spacers in the vicinity of the conductive member may also be used on the side areas which appear as a bordering of the profile in a radial section, thus one drawn transversely to the cable axis.

A preferred form of spacers for coaxial systems consists of two, three, or more radially axisymetrically mounted supporting elements. The profile, corresponding, e.g., to the designs in FIGS. 2*b* and 3*a* are then designed as shown by FIGS. 5*a* or 5*b*, respectively. As illustrated in FIGS. 5*a*, the supporting element 9 can either be adapted by outer shaping to the electrical requirements; or as illustrated in FIG. 5*b*, by the fact that excavations 11 and 12 are present on the surface of supporting element 10 adjacent the inner conductive member 2 and the tubular member 1. Such excavations are either filled with a conducting or semiconducting material or are coated with such material on the inner surface of the excavation. The profile of the supporting element in the third section plane perpendicular to the radial direction can be, e.g., round, oval, or rectangular, the latter also with rounded edges.

Figure 6A:
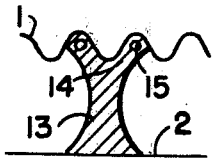
Figure 6C:
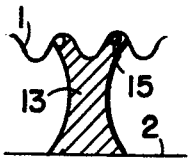
Figure 6B:
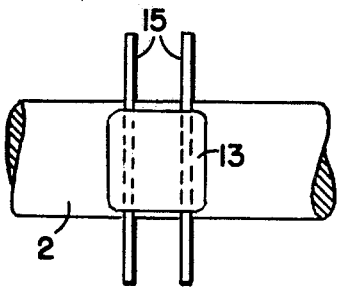
Figure 6D:
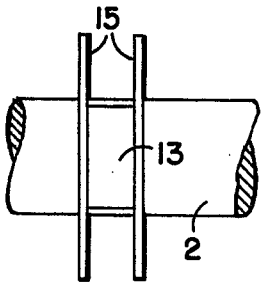

The individual supporting elements, usually three distributed around the periphery, can be held together on the inner conductor, for example, as illustrated in FIGS. 6*a* and 6*b*. It is advantageous to design the spacers 13 in such a way that they are held together by a spring-acting element 15, e.g., a spring-acting washer, the latter being especially advantageously mounted in a corrugation trough of the tubular member 1. The spacers 13 being provided with ends adjacent the outer tubular member 1 with tapered sections 14 within which, and still inside the corrugation troughs, the spring-acting elements 15, e.g. metal rings, are placed. Alternatively, as illustrated in FIGS. 6*b*, the connecting spring-acting elements 15, although inside the corrugation troughs, are mounted on the end of the actual spacer 13.

We claim:

1. A high voltage cable comprising:

an inner elongated conductor;

a tubular member encompassing and continuously disposed about said inner conductor, said tubular member having a diameter exceeding that of said inner elongated conductor and at least a portion thereof corrugated to exhibit enhanced flexibility, said corrugated portion including a plurality of adjacent ridges and furrows characterized by a longitudinal cross-section displaying a regular and periodic deformation pattern in the form of a plurality of adjacent peaks and troughs; and a plurality of spacers positioned along the longitudinal axis of said high voltage cable formed and extending between said inner conductor and said tubular member through an insulating environment, wherein said spacers have surfaces adjacent said inner conductive member which comprise conductive materials and wherein the remaining portions of such spacers are substantially non-conductive, said plurality of spacers each having a surface portion thereof in contact with an interior surface of said tubular member, said contacting surface portion of each of said plurality of spacers being configured to substantially follow an interval of the profile of said corrugated portion which includes at least one trough and portions of a pair of peaks adjacent to said at least one trough, said contacting surface portion of each spacer thereby extending across an interval of the profile of said corrugated portion occupied by said at least one trough and terminating between said portions of a pair of peaks in contact with interior surfaces of said tubular member over said interval, whereby the resistance of said cable to sparkover due to high potential is substantially increased while each of said plurality of spacers is maintained in position during flexing of said cable, each of said spacers being comprised of at least two support members and a spring-acting element, the latter being positioned in a corrugation trough of said tubular member and engaging said support members to maintain said support members in a plane perpendicular to said longitudinal axis.

2. An electrical cable in accordance with claim 1, wherein said spring-acting element is connected to a conducting layer on the surface of each of said support members adjacent said tubular member.

* * * * *